US009806435B2

(12) United States Patent
Jones

(10) Patent No.: US 9,806,435 B2
(45) Date of Patent: Oct. 31, 2017

(54) INSULATION PIERCING BATTERY CONNECTOR

(71) Applicant: Philadelphia Scientific UK Ltd., Bolton (GB)

(72) Inventor: Duncan Jones, Manchester (GB)

(73) Assignee: PHILADELPHIA SCIENTIFIC, EUROPE, Bolton (GB)

( * ) Notice: Subject to any disclaimer, the term of this patent is extended or adjusted under 35 U.S.C. 154(b) by 0 days.

(21) Appl. No.: 14/541,767

(22) Filed: Nov. 14, 2014

(65) Prior Publication Data

US 2015/0140855 A1 May 21, 2015

Related U.S. Application Data

(60) Provisional application No. 61/904,642, filed on Nov. 15, 2013.

(51) Int. Cl.

| | |
|---|---|
| ***H01R 11/20*** | (2006.01) |
| ***H01R 13/68*** | (2011.01) |
| ***H01R 4/24*** | (2006.01) |
| *H01R 101/00* | (2006.01) |

(52) U.S. Cl.

CPC ..... *H01R 4/2404* (2013.01); *H01R 11/20* (2013.01); *H01R 13/68* (2013.01); *H01R 2101/00* (2013.01)

(58) Field of Classification Search

CPC ..... H01R 13/68; H01R 11/20; H01R 4/2404
USPC ..... 439/389, 391, 393, 394, 409, 410, 420, 439/426, 427, 434–439
See application file for complete search history.

(56) References Cited

U.S. PATENT DOCUMENTS

| | | | | |
|---|---|---|---|---|
| 2,299,989 A * | 10/1942 | Johnson | H01R 11/20 | 219/136 |
| 2,395,373 A * | 2/1946 | Johnson | H01R 4/029 | 219/118 |
| 2,858,518 A * | 10/1958 | Chrystie | H01R 13/02 | 439/259 |
| 3,579,173 A * | 5/1971 | Greener | H01R 11/20 | 439/420 |
| 3,668,613 A * | 6/1972 | Klosin | H01R 4/2495 | 174/71 R |
| 3,853,385 A * | 12/1974 | Palazzetti | H01R 4/2404 | 439/190 |
| 6,492,894 B2 * | 12/2002 | Bone | H01H 85/0241 | 337/199 |
| 6,654,643 B1 * | 11/2003 | Schmid | H01R 4/2404 | 439/909 |

(Continued)

*Primary Examiner* — James Harvey
*Assistant Examiner* — Oscar C Jimenez
(74) *Attorney, Agent, or Firm* — Riverside Law LLP

(57) ABSTRACT

The present invention relates to a flexible connector for attaching electrical accessories to an industrial battery electrical cable. The connector includes a housing and an electrically conductive pin that is positioned within the housing and protrudes through a cable mating surface of the housing. The connector also includes a fuse positioned within the housing and electrically connected to the portion of the pin within the housing, and a conductive wire, wherein at least a portion of the wire is positioned within the housing and electrically connected to the fuse. At least the cable mating surface of the housing is suitably flexible to conform to the contours of an electrical cable insulation surface when the pin pierces through the insulation surface of the electrical cable to which the connector is attached.

16 Claims, 12 Drawing Sheets

(56) References Cited

U.S. PATENT DOCUMENTS

2013/0130538 A1* 5/2013 La Salvia ..... H01R 4/2408
439/391
2014/0266230 A1* 9/2014 Jones ..... H01M 10/484
324/434

* cited by examiner

INSULATION PIERCING BATTERY CONNECTOR

CROSS-REFERENCE TO RELATED APPLICATIONS

This application claims the benefit of priority of U.S. patent application Ser. No. 61/904,642, filed Nov. 15, 2013, the entire disclosure of which is incorporated by reference herein in its entirety.

BACKGROUND OF THE INVENTION

Industrial batteries are used in a wide variety of applications, such as for forklifts, robots, and other types of battery-powered vehicles. Users of industrial batteries often need to connect accessories to these batteries for monitoring or other purposes. However, connecting electrical accessories or monitoring taps to industrial batteries can be difficult. For instance, industrial batteries typically have bolted connectors that require tools to connect electrical accessories to the batteries. Further, connecting accessories to an industrial battery can also be dangerous. Industrial batteries often contain corrosive chemicals such as sulfuric acid, which is present in the most common type of industrial battery, i.e., a lead-acid battery.

Therefore, it is desirable to provide a way to connect an electrical accessory to an industrial battery quickly and easily, but that can withstand the corrosive environment typically associated with industrial batteries. One way to provide such a connection is to tap into the cable on the battery. However, devices for tapping into the battery cable that are currently available can unnecessarily damage the cable and do not provide a way for ensuring that the newly tapped connection can remain uncompromised in a corrosive environment.

Thus, there is a need in the art for a device that can be used to quickly and easily connect monitoring taps or other types of electronic accessories to an industrial battery in a reliable manner and without being affected by the corrosive nature of such batteries. The present invention addresses this unmet need in the art.

BRIEF SUMMARY OF THE INVENTION

The present invention relates to a flexible connector for attaching electrical accessories to an industrial battery electrical cable. The connector includes a housing, an electrically conductive pin, wherein at least a portion of the pin is positioned within the housing and protrudes through a cable mating surface of the housing, a fuse positioned within the housing and electrically connected to the portion of the pin within the housing, and a conductive wire, wherein at least a portion of the wire is positioned within the housing and electrically connected to the fuse, wherein at least the cable mating surface of the housing is suitably flexible to conform to the contours of an electrical cable insulation surface when the pin pierces through the insulation surface of the electrical cable. In one embodiment, the connector includes a means for securing the housing to the electrical cable. In another embodiment, the housing includes a recess around at least a portion of its perimeter, such that the means for securing the housing to the cable fits within the recess. In another embodiment, the means for securing the housing to the cable is a cable tie. In another embodiment, the fuse is a printed circuit board (PCB). In another embodiment, the cable mating surface is curved when in its relaxed state. In another embodiment, the cable mating surface comprises an extended ring surrounding the region from which the pin protrudes from the housing. In another embodiment, the wire is electrically connected to an electrical accessory for an industrial battery. In another embodiment, the housing is constructed of a rubber-like material. In another embodiment, the rubber-like material is a thermoplastic elastomer. In another embodiment, the thermoplastic elastomer is SANTOPRENE thermoplastic vulcanizate. In another embodiment, the connector includes a plurality of electrically conductive pins that protrude through a plurality of cable mating surfaces of the housing.

BRIEF DESCRIPTION OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities of the embodiments shown in the drawings.

DETAILED DESCRIPTION

Figure 1:
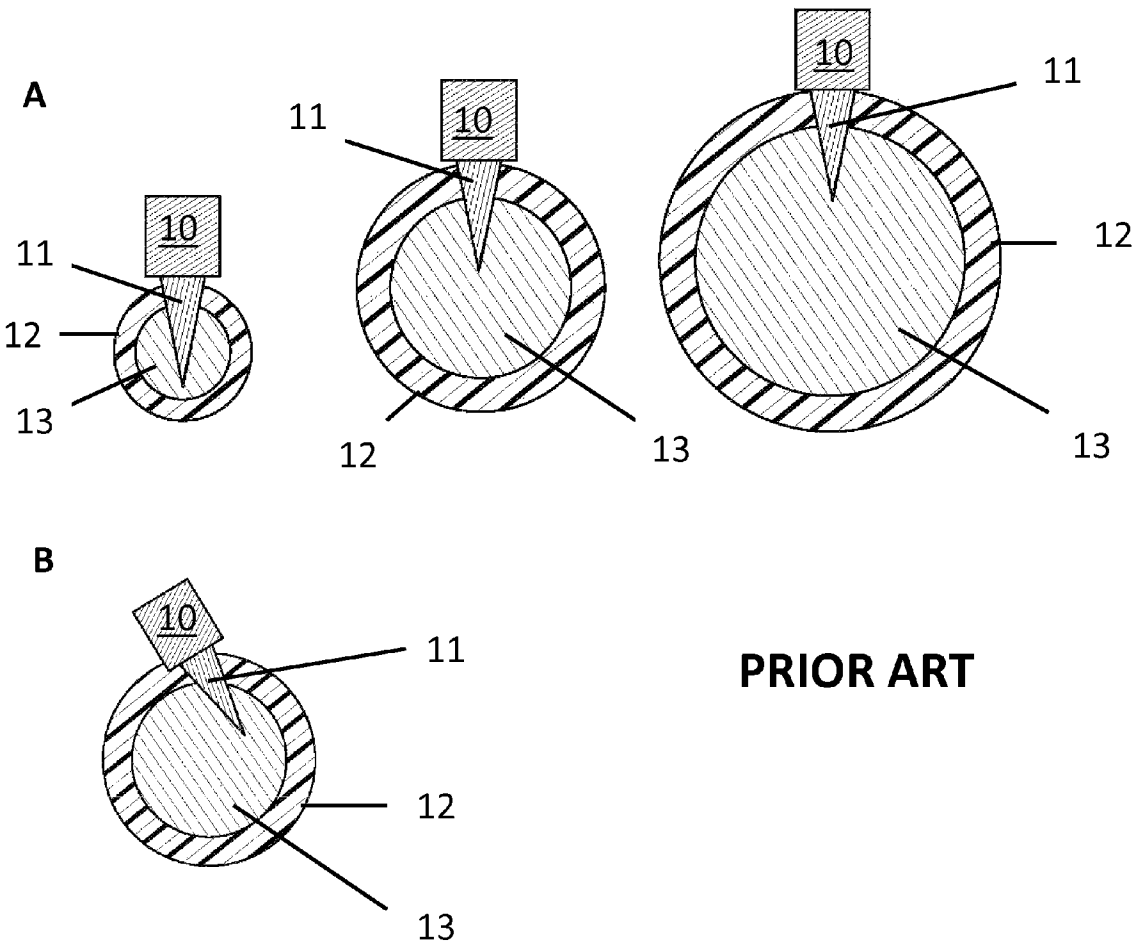
PRIOR ART Figure 1
FIG. 1 is a series of schematic diagrams showing a cross-sectional view of an existing connector design attached to an electrical cable.

It is to be understood that the figures and descriptions of the present invention have been simplified to illustrate elements that are relevant for a clear understanding of the present invention, while eliminating, for the purpose of clarity, many other elements found in the field of electrical cables and connectors. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Definitions

Unless defined otherwise, all technical and scientific terms used herein have the same meaning as commonly understood by one of ordinary skill in the art to which the invention pertains. Although any methods and materials similar or equivalent to those described herein can be used in the practice for testing of the present invention, the preferred materials and methods are described herein. In describing and claiming the present invention, the following terminology will be used.

It is also to be understood that the terminology used herein is for the purpose of describing particular embodiments only, and is not intended to be limiting.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, or ±0.1% from the specified value, as such variations are appropriate.

Ranges: throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Description

The present invention relates to a device for connecting electrical accessories to industrial batteries. The device of the present invention solves the problem of connecting monitoring taps, power taps, or other accessories to industrial battery cables by incorporating a piercing probe or pin into a housing that can be permanently or removably attached to a cable without compromising the insulation or ingress protection provided by the cable sheath. The connector of the present invention is an insulation-piercing wiretap with a uniquely flexible, saddle-shaped housing that can conform to the shape and size of any electrical cable, thereby providing both a well-sealed and sturdy connection.

The present invention therefore represents a significant improvement over existing wiretap designs. For example, referring to FIG. 1, a first existing connector design is shown. In FIG. 1A, the connector generally includes a rigid head or housing 10 from which a conducting pin 11 protrudes downward and punctures the insulation 12 of a cable having a various size range, as illustrated. In each case, pin 11 pierces through insulation 12 of the cable to come into contact with the internal cable wire 13. This particular design is used because the relatively small profile of the connector head 10 allows the head to sit relatively flat on the surface of most cable sizes. However, as shown in FIG. 1B, this connector design is not stably attached to the cable, with or without a cable tie, and therefore the connector inevitably shifts in position. Accordingly, head 10 does not maintain an adequate or sustainable seal with the cable surface, which allows a portion of pin 11 to be exposed to the surrounding environment, and also subjects pin 11 to snapping. Further, the resulting shifting of this connector design causes a user to remove and re-puncture the cable wire, thereby causing additional and unnecessary damage to the cable's integrity. In addition, the relatively small size of connector head 10 is not suitably sized to include a fuse, thereby making head 10 prone to short-circuiting, overloading, or some other form of electrical device failure.

Figure 2:
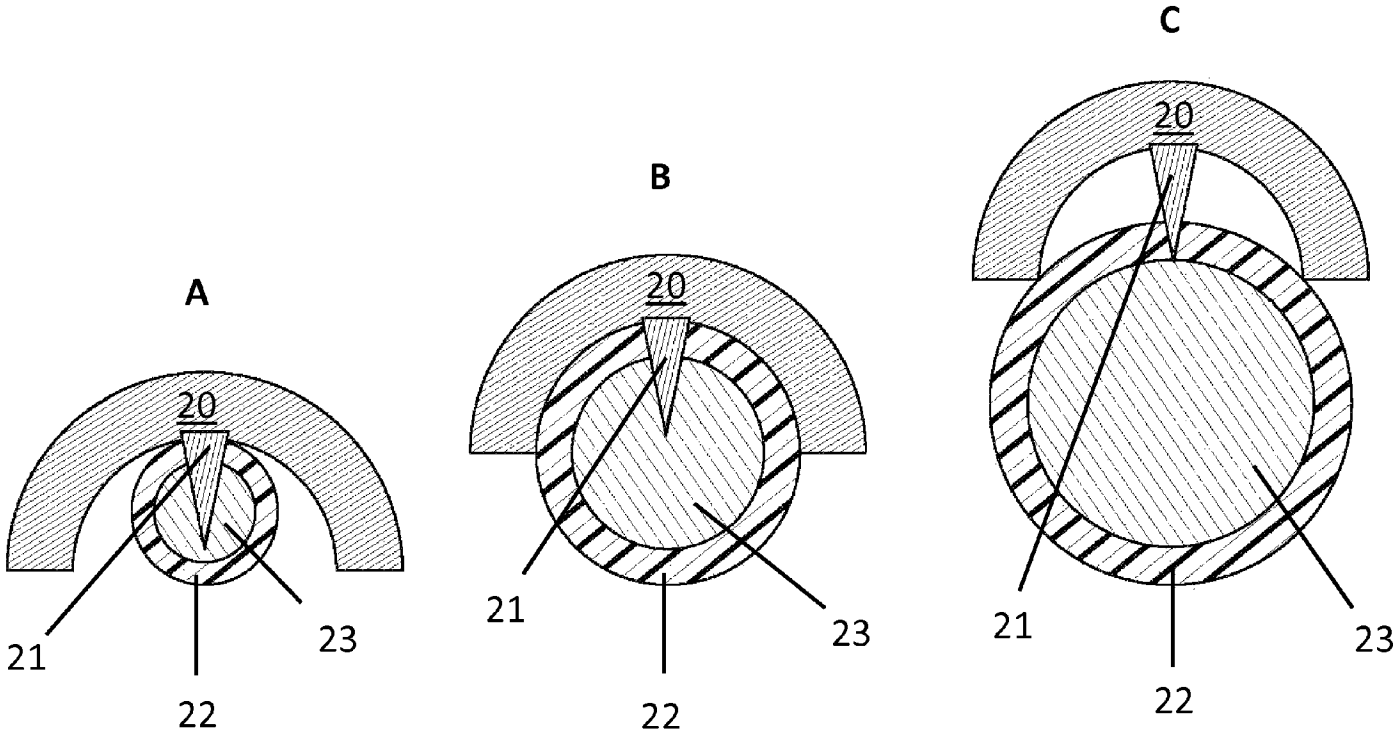
PRIOR ART Figure 2
FIG. 2 is a series of schematic diagrams showing a cross-sectional view of another existing connector design attached to an electrical cable.

In another example and with reference to FIG. 2, a second existing connector design is shown attached to various sizes of cable. Here, the connector design includes a generally saddle-shaped, rigid and inflexible housing 20 from which a conducting pin 21 protrudes downward and punctures the insulation 22 of the various sized cables. Although housing 20 provides a more stable and sturdy mating of the connector head to the cable, this improved stability is only effective for the particular sized cable that matches the exact, fixed size of the saddle-shaped housing, as shown in FIG. 2B. For smaller sizes of cable (FIG. 2A), the rigid connector housing is oversized, and therefor can shift in position. For larger sizes of cable (FIG. 2C), the rigid connector housing is undersized, and therefor can shift in position. Further, as shown in FIG. 2C, pin 21 may not completely pierce through insulation 22 of the cable, thereby preventing an effective or reliable electrical connection.

Figure 3:
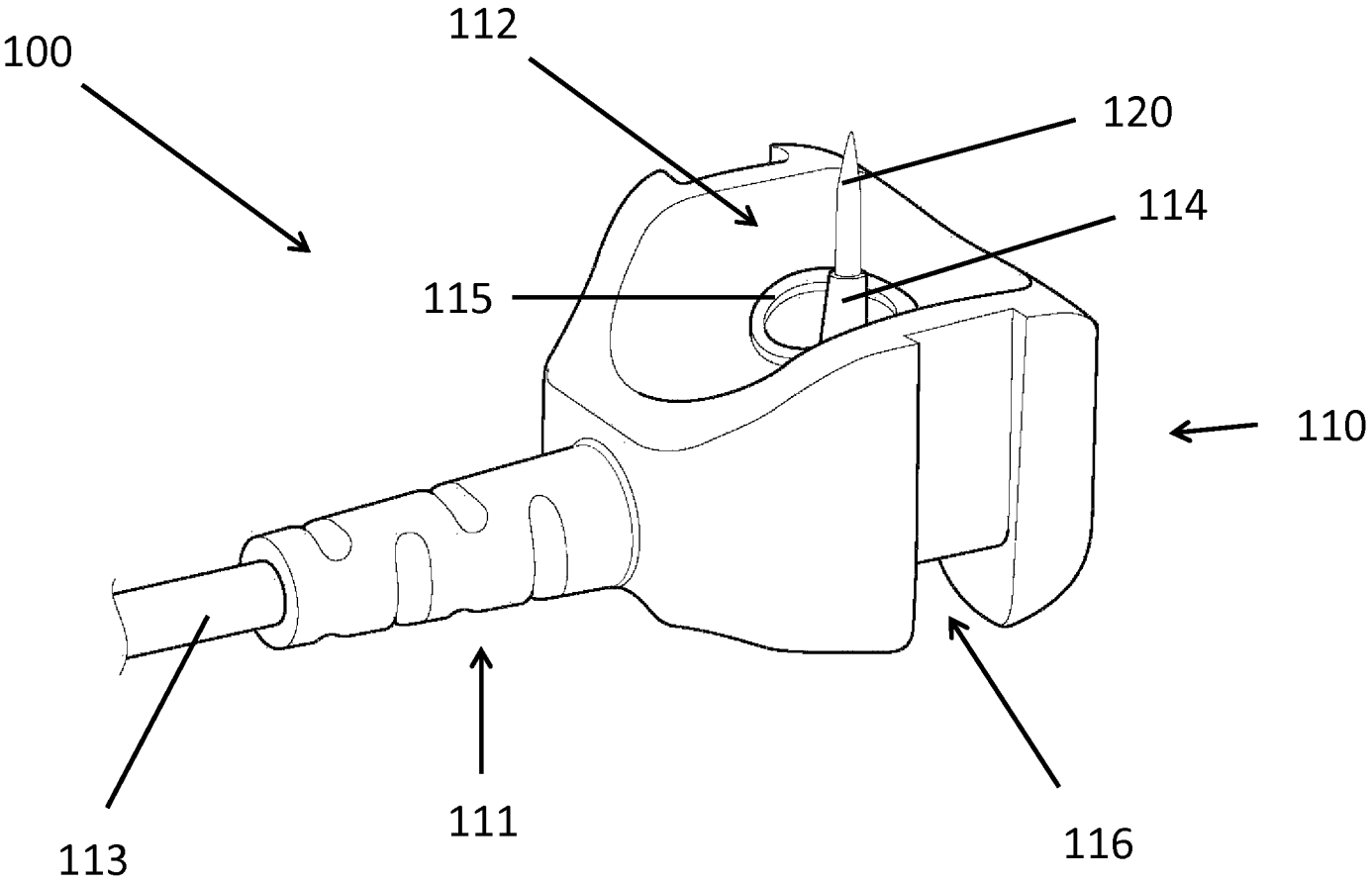
FIG. 3 is a schematic diagram of an exemplary connector of the present invention.

Accordingly, the present invention significantly improves upon these existing designs by both creating a more sturdy engagement and properly sealed contact with the cable, and can do so with any cable size or surface profile. Referring now to FIG. 3, an exemplary embodiment of a connector 100 of the present invention is shown. Connector 100 includes a housing having a head portion 110 from which an electrically conductive pin 120 protrudes from a cable mating surface 112 of head 110, and a neck portion 111 into which a wire 113 electrically connects to the internal components of connector 100 within head 110. Pin 120 has a pointed tip that is suitable for penetrating the insulation of a battery cable. Preferably, pin 120 is composed of a conductive and sturdy material, such as a conductive metal. In its relaxed state, cable mating surface 112 of head 110 is suitably curved for conforming to the most common or standard sized cable surface profile as found on an industrial battery. Cable mating surface 112 also includes a fitted collar 114 extending outwardly from surface 112, such that it snugly fits around the base of pin 120 to create an effective seal. Cable mating surface 112 further includes an extended ring or flange 115 surrounding collar 114 and pin 120. Functionally, ring 115 presses into the surface of the targeted cable when surface 112 mates with the pierced cable surface, creating a gasket that further improves the seal protecting the pin 120 and internal electrical components housed within head 110 of connector 100. Head 110 also optionally includes a segmented or continuous recess or groove 116 wrapping about the remaining perimeter of head 110, including any sidewalls adjacent cable mating surface 112 or backside opposing cable mating surface 112. In this way, groove 116 serves as a nesting site for a cable tie or other securing component to engage head 110 and wrap around the cable to securely fasten connector 100 to the cable when a connection between connector 100 and the cable is made.

As mentioned previously, connector 100 is unique in that cable mating surface 112 is flexible, thereby allowing surface 112 to substantially conform to any sized and shaped cable surface while maintaining a stable and sealed connection. Thus, the connector of the present invention can be used with any type of battery or electrical cable. In one embodiment, the connector can be used with a cable connecting two or more cells of a battery, for example in European-style batteries. In another embodiment, the connector can be used with a power cable that connects a battery to a vehicle, charger, or any type of electrical accessory. The connector of the present invention can be used with a wide variety of electrical accessories, for example, but not limited to: monitoring battery devices, such as electrolyte monitoring devices, temperature monitoring devices, electric current measuring devices; and battery usage monitoring devices; powered battery accessories, such as cooling devices, electrolyte mixing devices, and battery safety lockout devices; battery identification devices, such as devices that broadcast or communicate the battery status and identity; truck accessories that require power, such as warning lights, beepers, cabin heaters, voice picking systems, and cameras; or truck monitoring devices that monitor the use or location of a truck. However, the use of the connector of the present invention is not limited to the specific examples listed herein, and the connector can be used in any application for which tapping into a battery cable or any other type of electrical cable is necessary.

Figure 4:
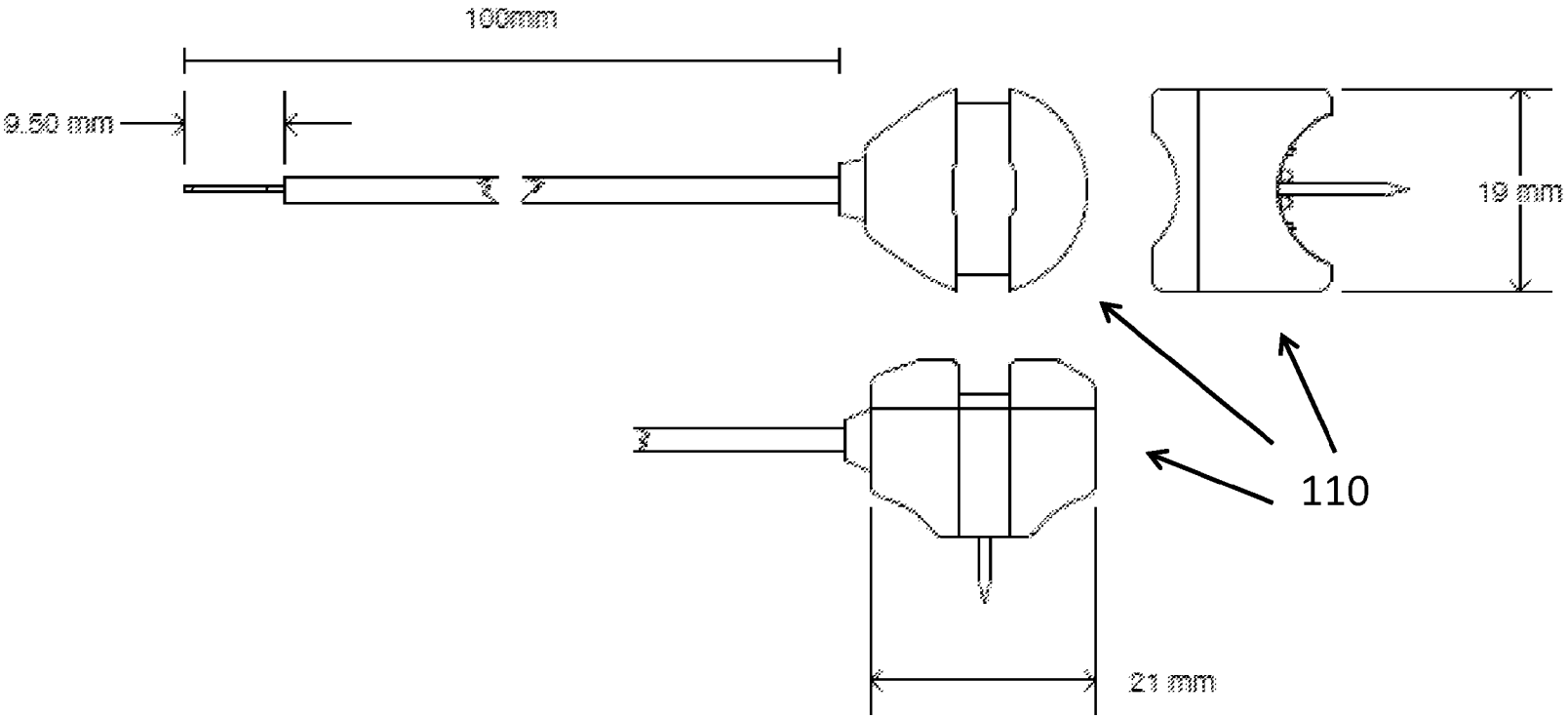
FIG. 4 is a schematic diagram of an exemplary connector of the present invention, showing dimensions of portions of the connector.

In one embodiment, at least a portion of head 110 forming cable mating surface 112 comprises a flexible material that can conform to the contours of any size and shaped surface of a cable on an industrial battery. In a preferred embodiment, the entire connector housing head 110 is constructed of a flexible material. Referring now to FIG. 4, exemplary dimensions of connector 100 are shown. For example, the width of housing head 110 may be about 19 mm, the depth may be about 21 mm. However, it should be appreciated that the connector of the present invention is not limited or restricted to any particular size, and therefore may be constructed at any size desirable.

Figure 5:
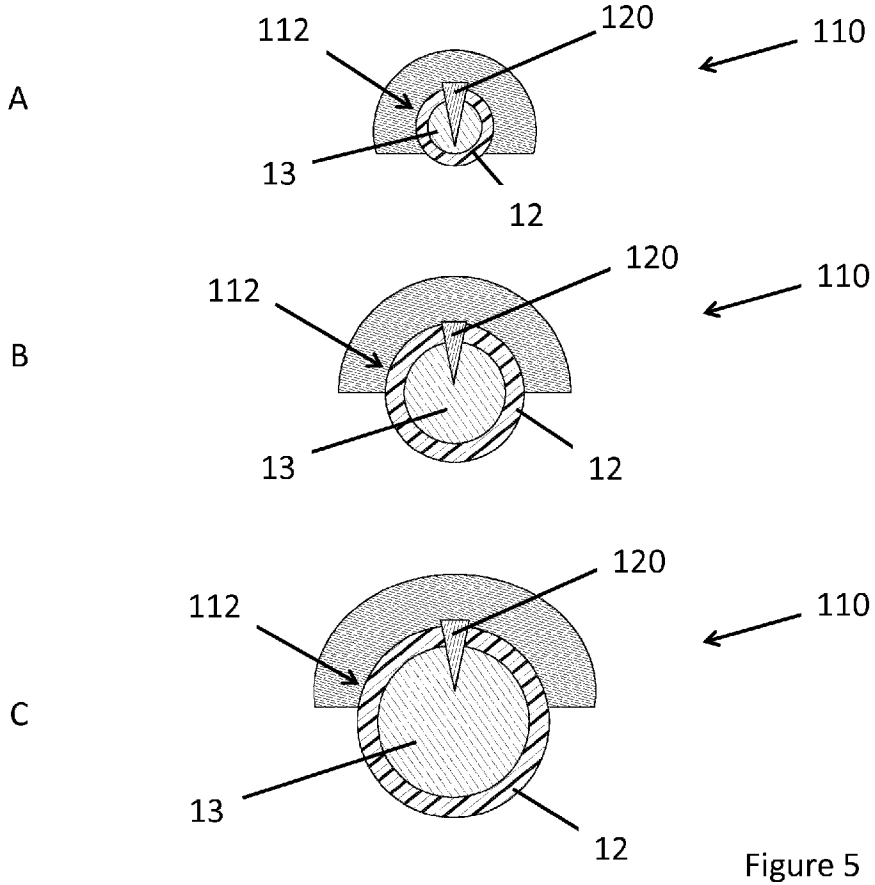
FIG. 5 is a series of schematic diagrams showing a cross-sectional view of one embodiment of the connector of the present invention attached to an electrical cable.

Referring now to FIG. 5, a cross-sectional view of the connector of the present invention is shown when attached to different sizes of cable. Pin 120 of the connector pierces through insulation 12 of the targeted cable to contact electrical wire 13 therein. The cable mating surface 112 of head 110 substantially conforms or completely conforms to the outer surface of insulation 12 of the targeted cable. Therefore, pin 120 of connector 100 is not exposed to the environment surrounding connector 100 and the tapped cable. Accordingly, pin 120 will not be significantly exposed to any corrosive agents present in the environment, and pin 120 can conduct electrical current from wire 13 while remaining insulated from the environment.

Figure 8:
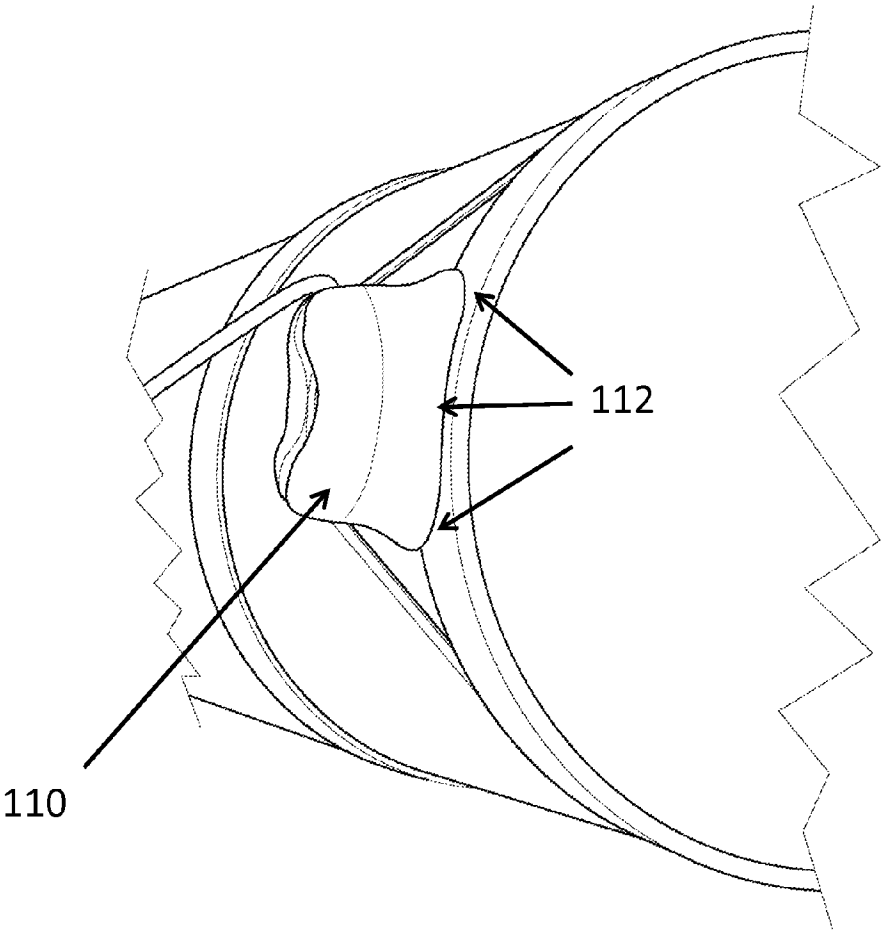
FIG. 8 is a schematic of an exemplary connector attached to a large surface, with the mating surface of the connector head flexing outwardly to maximize the contact area of the connector to the targeted surface.

As shown in FIGS. 5A-5C, connector head 110 conforms to the surface of the cable regardless of the size or shape of the cable, due to the flexibility of the material forming the cable mating surface of the connector head housing. For example, in FIG. 5A, a relatively small diameter cable is shown, such as a cable having a cross-sectional area of <25 $mm^2$. In such an example, cable mating surface 112 of connector head 110 flexes inwardly or downward to mate with the cable surface, such that it surrounds a large portion of the cable perimeter, while pin 120 pierces insulation 12 of the cable suitable for making effective contact with cable wire 13 in a sealed configuration. Notably, pin 120 has a length such that it does not pass all the way through the smallest cables found on industrial batteries, as this would otherwise lead to compromising the insulation of the cable on the side of the cable opposing the attached connector. In FIG. 5B, a relatively medium-sized cable is shown, such as a cable having a cross-sectional area of about 25 to 90 $mm^2$. Again, cable mating surface 112 of connector head 110 surrounds a portion of the cable perimeter, while pin 120 pierces insulation 12 of the cable suitable for making effective contact with cable wire 13 in a sealed configuration. In FIG. 5C, a relatively large-sized cable is shown, such as a cable having a cross-sectional area of about >90 $mm^2$. Here, cable mating surface 112 of connector head 110 flexes outwardly or upward to mate with the cable surface, such that it surrounds a portion of the cable perimeter, while pin 120 pierces insulation 12 of the cable suitable for making effective contact with cable wire 13 in a sealed configuration. In each case, pin 120 pierces through insulation 12 to come into contact with wire 13 of the cable, while cable mating surface 112 of connector head 110 flexes suitably to maximize contact of surface 112 with the surface of the cable to form a superior seal. While most industrial battery cables have a cylindrical cross-sectional shape, additional cable surface profiles may exist or may be used in the future, and thus the flexibility of cable mating surface 112 allows the connector of the present invention to conform to the contours of virtually any cable wire shape. For example, as shown in FIG. 8, an exemplary connector is attached to a very large surface, with the mating surface of the connector head flexing outwardly to maximize the contact area of the connector to the targeted surface.

Figure 6:
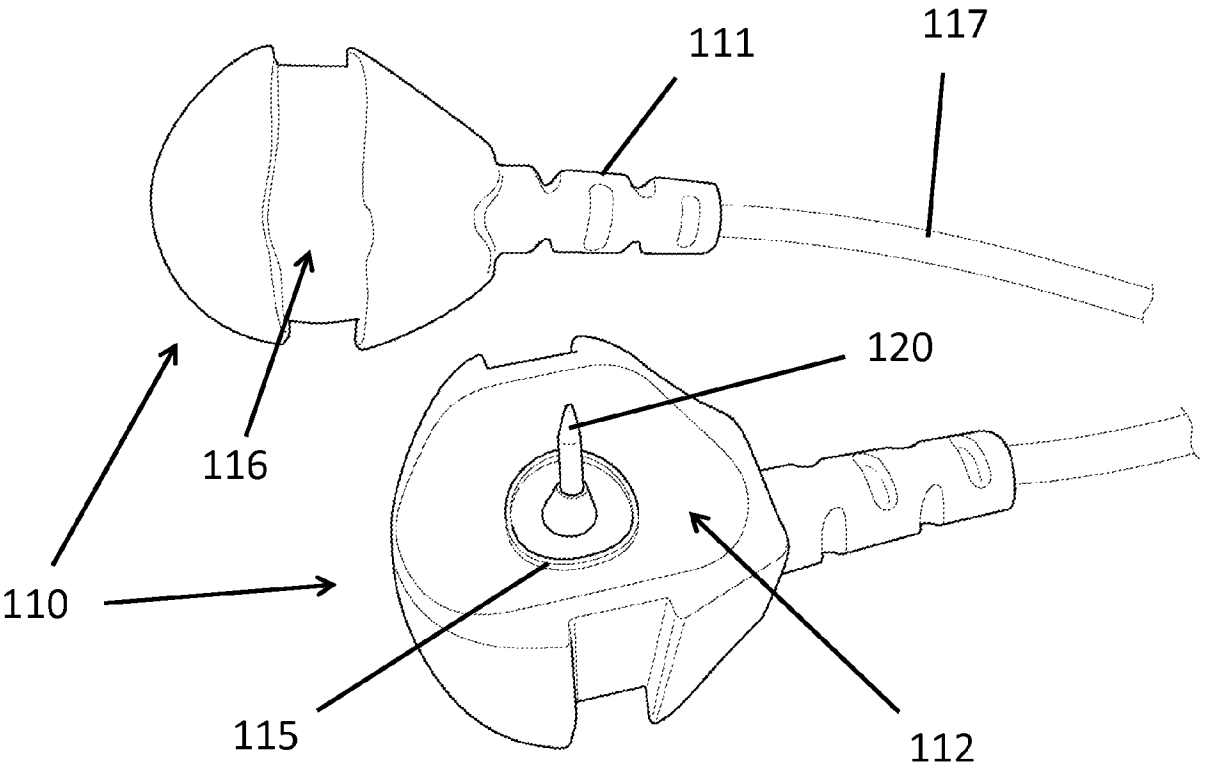
FIG. 6 is a schematic of exemplary connectors of the present invention.
Figure 7:
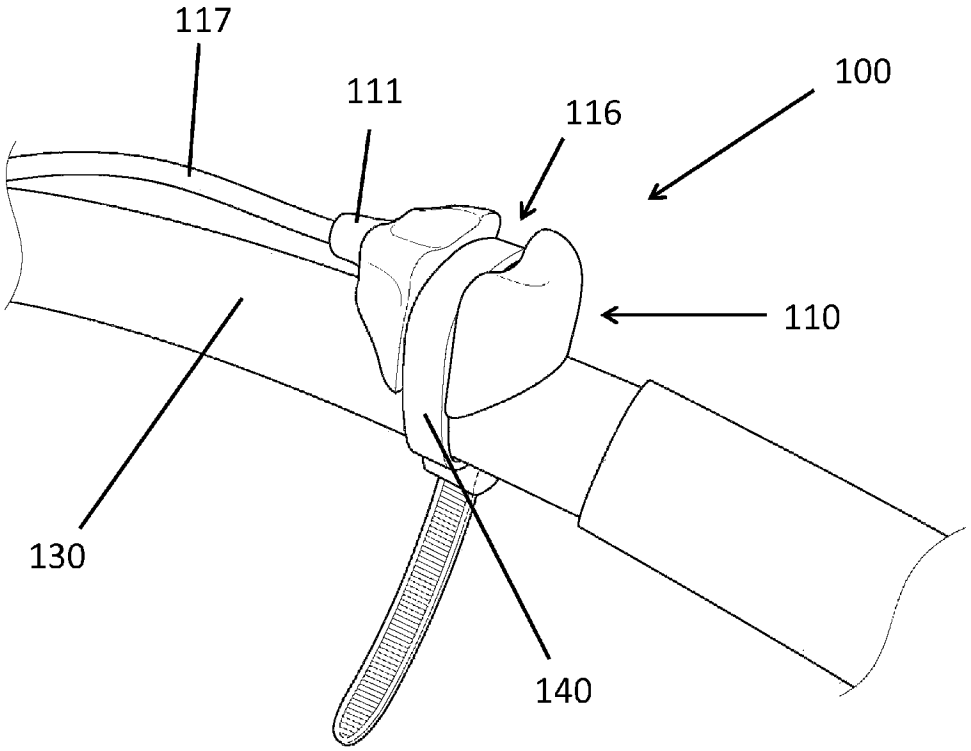
FIG. 7 is a schematic of an exemplary connector of the present invention attached to an electrical cable.

Referring now to FIGS. 6 and 7, a working example of connector 100 is shown in isolation (FIG. 6) and when mounted on a cable (FIG. 7). As shown in FIG. 7, connector 100 is electrically engaged with a cable 130 from an industrial battery, such that pin 120 has pierced through the insulation of cable 130, allowing cable mating surface 112 to be in maximum contact with the outer surface of cable 130. Wire 117 extends from neck 111 of connector 100 and leads to the electronic accessory drawing power (not shown). A cable tie 140 is positioned within recess 116 and wraps around connector head 110 and cable 130 to further secure connector 100 to cable 130, and to generate a suitable pressure to maintain cable mating surface 112 in a flexed state with maximum surface contact of cable 130. Thus, when cable tie 140 is tightened, a superior seal between cable mating surface 112 of connector head 110 and cable 130 is formed. Accordingly, when connector head 110 is attached to cable 130, pin 120 (not shown) pierces the insulation surrounding cable 130 to allow pin 120 to contact the conducting wire within cable 130. Further, pin 120 is sealed from the environment surrounding connector 100 and cable 130, thereby preventing exposure to any corrosive vapor, liquid, or other material in the environment.

Figure 9:
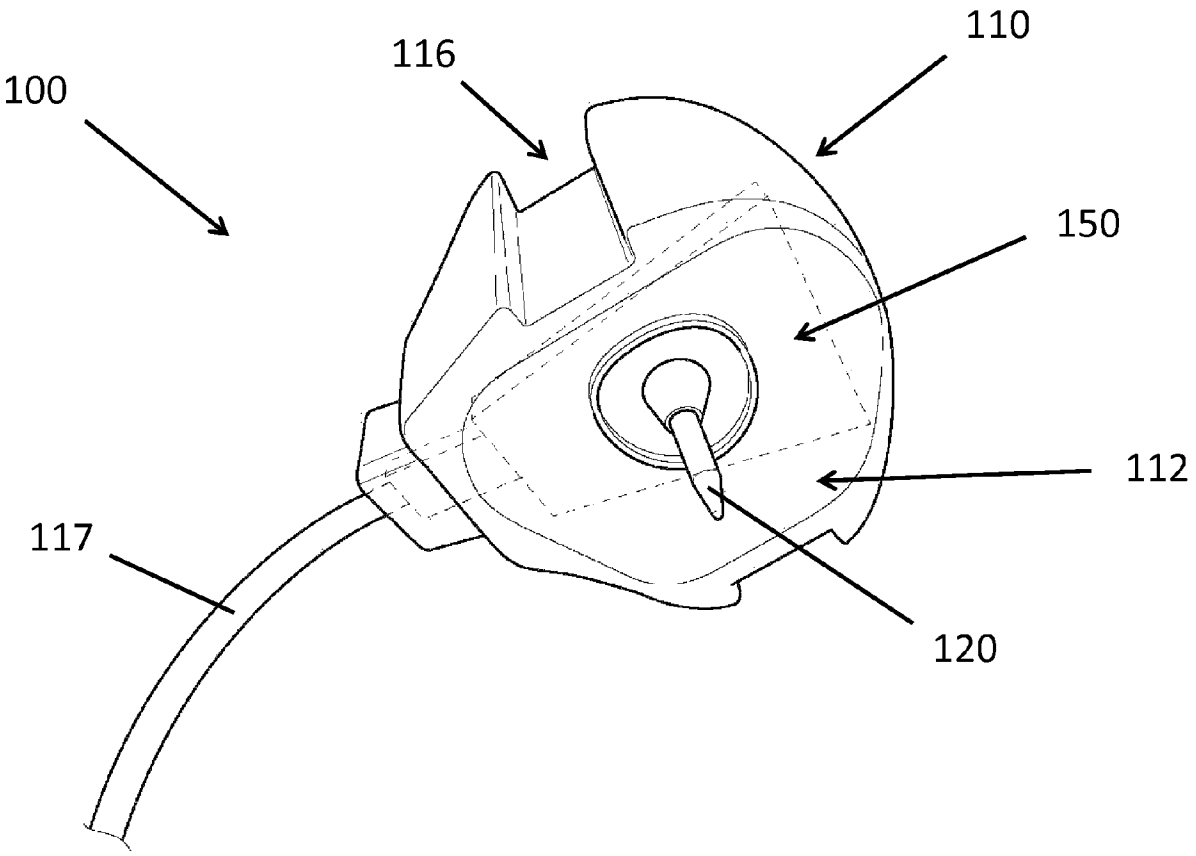
FIG. 9 is a schematic of an exemplary connector of the present invention.

Wire 117 may be connected to a fuse 150, wherein the fuse is preferably a printed circuit board (PCB) or integrated with a PCB. The fuse may be further connected to pin 120. A portion of pin 120, the fuse 150, and a portion of wire 117 are all contained within connector head 110, thereby sealing and protecting them from the surrounding environment. Electrical current can flow from the tapped battery cable wire through pin 120, to and through the fuse 150, and to and through the wire 117 to the electrical accessory, such as a monitor for an industrial battery. As would be understood by a person skilled in the art, all portions of wire 117 not contained within connector head 110 are preferably covered by an electrically insulating material, such as PVC. For example, referring now to FIG. 9, another working exemplary embodiment of connector 100 is shown with the housing of connector head 110 composed of a flexible material. Pin 120 is connected to a fuse 150 that is completely encapsulated within connector head 110. Fuse 150 is further connected to wire 117 within connector head 110. In this embodiment, fuse 150 is a PCB. In other embodiments, fuse 150 can be any type of fuse as would be understood by a person skilled in the art. In various embodiments, fuse 150 can have any rating suitable for electrical accessory and/or industrial battery applications. While the preferred device as shown includes a fuse, it should be appreciated that the present invention is not limited to any particular type of fuse, or to the inclusion of a fuse at all.

Figure 10:
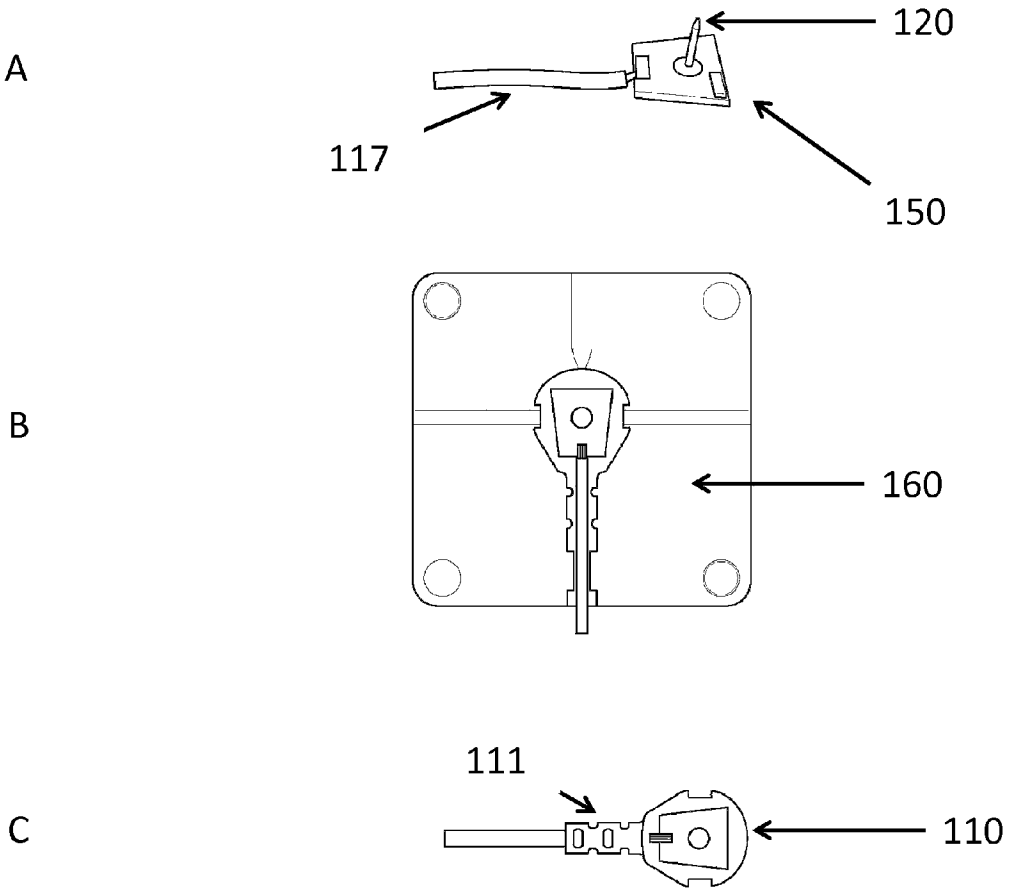
FIG. 10 is a schematic showing an exemplary embodiment of the connector of the present invention at various stages of the manufacturing process.

Referring now to FIG. 10, the primary steps in the manufacturing process of the connector of the present invention are shown. In FIG. 10A, the connector is shown prior to the formation of the head and neck portions of the connector housing. The pin 120 is first inserted through the PCB/fuse 150 and electrically connected thereto. The accessory device wire 117 is then electrically connected to the PCB. As shown in FIG. 10B, the connector is placed in an injection molding tool 160, and a suitable thermoplastic elastomer having the desired flexibility characteristics desired is then injected into the mold to create the housing for the connector head 110 and neck portions 111. The resulting connector is shown in FIG. 10C, with the flexible housing formed around the fuse and a portion of the pin. The neck of the connector is also formed during the injection molding process, such that the head 110 and neck 111 portions of the connector 100 may be a single unit, if desired. In other embodiments, the neck and head portions may be separate components that are assembled together. Depending on the type of material forming the connector neck and the material forming the insulation surrounding the wire, the neck may form a mechanical or chemical bond around the insulated wire, such that no part of the electrical components of the connector are exposed to the environment once the housing is formed, except for the portion of the pin designed to pierce through the insulation of the targeted battery cable.

It should be appreciated that the flexible housing of the connector head 110 can be constructed from a number of materials. For example, in one embodiment, the housing can comprise a rubber or a thermoplastic vulcanite such as SANTOPRENE thermoplastic elastomer, which is desirable for its chemical resistance and durability. In another embodiment, the housing can comprise a suitably flexible silicone. However, it should be appreciated that the housing can be constructed from any suitably flexible and moldable polymer that can be used in electrical applications and can withstand the environment surrounding an industrial battery.

Figure 11:
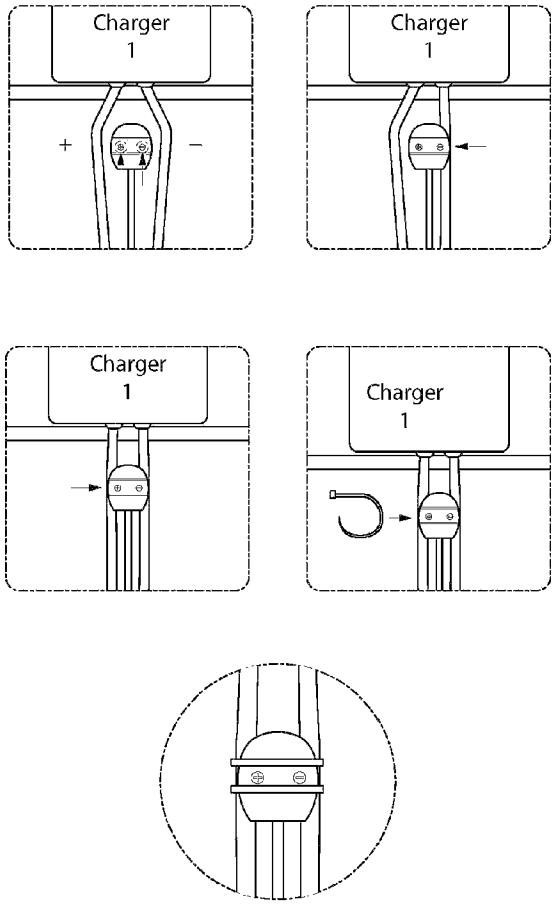
FIG. 11 is a series of schematic diagrams showing an exemplary multi-wire connector of the present invention.
Figure 12:
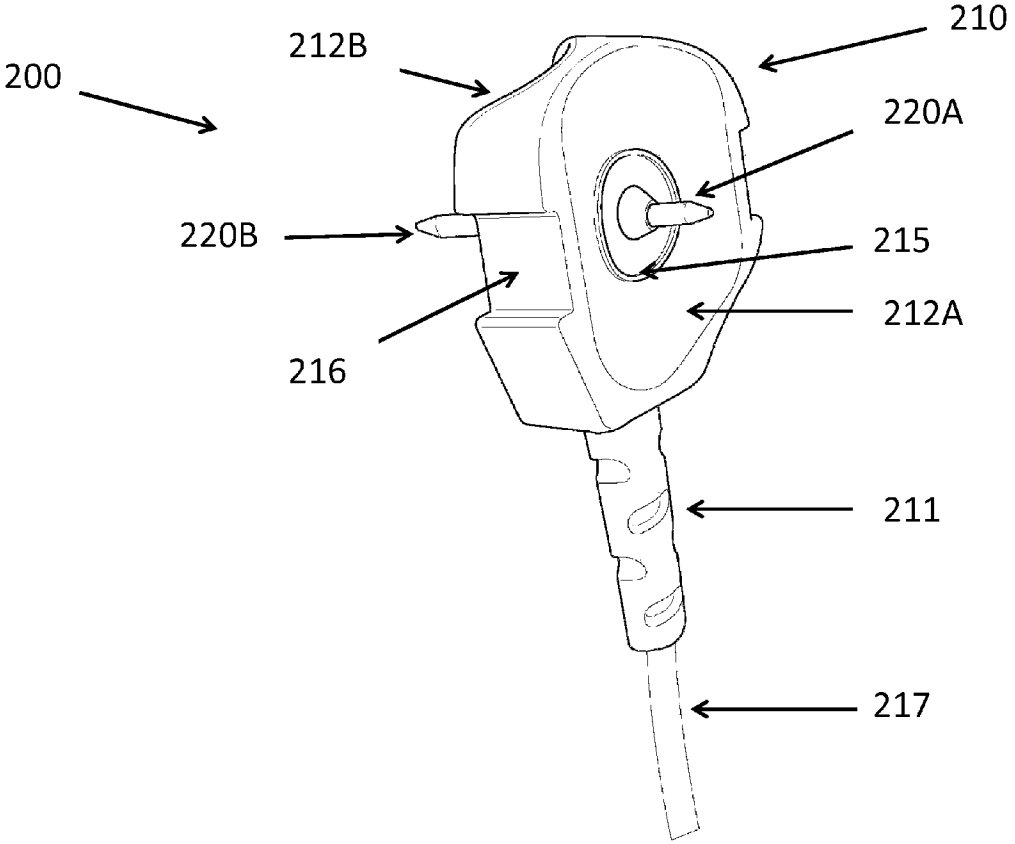
FIG. 12 is a schematic of another exemplary multi-wire connector of the present invention.

Referring now to FIG. 11, another embodiment of the connector of the present invention is shown which can be used to connect two wires simultaneously to an accessory. As shown in FIG. 11, the connector head housing may include multiple conducting pins protruding from multiple cable mating surfaces, such that the connector can make a stable and sealed electrical connection with multiple battery cables, as desired. Another exemplary embodiment of such a multi-pin connector is shown in isolation in FIG. 12. Having like parts as shown for connector 100, connector 200 may include a head portion 210, a neck portion 211, an extending wire 217 extending from connector 200 to the electrical device, a first mating surface 212A, a second mating surface 212B, a first pin 220A, a second pin 220B, and first and second rings 215.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention. The appended claims are intended to be construed to include all such embodiments and equivalent variations.

What is claimed is:

1. A connector for attaching electrical accessories to an electrical cable, comprising:

a housing;

an electrically conductive pin, wherein at least a portion of the pin is positioned within the housing and protrudes through a cable mating surface of the housing;

a fuse positioned within the housing and electrically connected to the portion of the pin within the housing; and a conductive wire, wherein at least a portion of the wire is positioned within the housing and electrically connected to said fuse;

wherein at least the cable mating surface of the housing is suitably flexible to completely conform to the contours of an electrical cable insulation surface when the pin pierces through the insulation surface of the electrical cable.

2. The connector of claim 1, further comprising a means for securing the housing to the electrical cable.

3. The connector of claim 1, wherein the housing further comprises a recess around at least a portion of its perimeter, such that the means for securing the housing to the cable fits within the recess.

4. The connector of claim 2, wherein the means for securing the housing to the cable is a cable tie.

5. The connector of claim 1, wherein the fuse is a printed circuit board (PCB).

6. The connector of claim 1, wherein the cable mating surface is curved when in its relaxed state.

7. The connector of claim 1, wherein the cable mating surface comprises an extended ring surrounding the region from which the pin protrudes from the housing.

8. The connector of claim 1, wherein the wire is electrically connected to an electrical accessory for an industrial battery.

9. The connector of claim 8, wherein said electrical accessory is selected from the group consisting of an electrolyte monitoring device, temperature monitoring device, current measuring device, cooling device, heating device, electrolyte mixing device, battery safety lockout device, battery usage monitoring device, battery identification device, warning light, camera, truck cabin heater, and truck monitoring device.

10. The connector of claim 1, wherein said housing is constructed of a rubber-like material.

11. The connector of claim 10, wherein the rubber-like material is a thermoplastic elastomer.

12. The connector of claim 11, wherein the thermoplastic elastomer is SANTOPRENE thermoplastic vulcanizate.

13. The connector of claim 1, wherein the connector comprises a plurality of electrically conductive pins that protrude through a plurality of cable mating surfaces of the housing.

14. The connector of claim 1, wherein the housing further comprises a collar extending from the housing to cover at least a portion of the conductive pin.

15. The connector of claim 1, wherein the connection points between the conductive wire, fuse and pin are fully encapsulated and sealed within the interior of the housing.

16. An electrical cable connector, comprising:

a housing having at least one cable mating surface area;

an electrically conductive pin, wherein at least a portion of the pin is positioned within the housing and protrudes through the at least one cable mating surface area of the housing;

a fuse positioned within the housing and electrically connected to the portion of the pin within the housing; and a conductive wire, wherein at least a portion of the wire is positioned within the housing and electrically connected to the fuse;

wherein the at least one cable mating surface area of the housing is suitably flexible such that the entire cable mating surface area substantially conforms to the contours of a cable insulation surface when the pin pierces through the insulation surface of the cable.

* * * * *